US008151899B2

(12) United States Patent
Tuomas

(10) Patent No.: US 8,151,899 B2
(45) Date of Patent: Apr. 10, 2012

(54) METHOD AND DEVICE FOR ROCK DRILLING

(75) Inventor: Göran Tuomas, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 178 days.

(21) Appl. No.: 12/311,018

(22) PCT Filed: Sep. 12, 2007

(86) PCT No.: PCT/SE2007/000796

§ 371 (c)(1),
(2), (4) Date: Mar. 16, 2009

(87) PCT Pub. No.: WO2008/036013

PCT Pub. Date: Mar. 27, 2008

(65) Prior Publication Data

US 2010/0288519 A1 Nov. 18, 2010

(30) Foreign Application Priority Data

Sep. 21, 2006 (SE) ..... 0601969

(51) Int. Cl.
*E21B 7/18* (2006.01)

(52) U.S. Cl. ..... 173/1; 173/4; 173/11

(58) Field of Classification Search ..... 173/1, 4, 173/11, 200, 206, 212; 175/135, 189, 298
See application file for complete search history.

(56) References Cited

U.S. PATENT DOCUMENTS

| | | | | |
|---|---|---|---|---|
| 2004/0244493 | A1* | 12/2004 | Keskiniva et al. | 73/702 |
| 2004/0251049 | A1* | 12/2004 | Keskiniva | 175/50 |
| 2005/0006143 | A1* | 1/2005 | Uitto | 175/27 |
| 2005/0139368 | A1* | 6/2005 | Keskiniva et al. | 173/206 |

FOREIGN PATENT DOCUMENTS

| | | | |
|---|---|---|---|
| GB | 2047794 | A | 12/1980 |
| WO | WO 9947313 | A1 | 9/1999 |
| WO | WO 03/004822 | A1 | 1/2003 |
| WO | WO 03033216 | A1 | 4/2003 |
| WO | WO 03033873 | A1 | 4/2003 |
| WO | WO 03/095153 | A1 | 11/2003 |
| WO | WO 2005002802 | A1 | 1/2005 |
| WO | WO2005/080051 | A1 | 9/2005 |
| WO | WO 2006003259 | A1 | 1/2006 |
| WO | WO 2006072666 | A1 | 7/2006 |

* cited by examiner

*Primary Examiner* — Rinaldi Rada
*Assistant Examiner* — Nathaniel Chukwurah
(74) *Attorney, Agent, or Firm* — Mark P. Stone

(57) ABSTRACT

A method for producing Shockwave pulses in a tool direction (R) of a pulse machine (1) having a housing (2), wherein an impulse piston (4) is arranged, wherein the impulse piston is influenced by a first force in a direction opposite to said tool direction through a first fluid pressure (Pi) in a first chamber (7), and by a second force in said tool direction, wherein 'a Shockwave pulse is produced through a rapid relief of the first fluid pressure after displacement of the impulse piston (4) relative to the housing in a direction opposite to the tool direction, is distinguished in that the length of the shock wave is controlled by the length (L) of said displacement is regulated. The invention also concerns a device, rock drilling machine and a rock drilling rig.

48 Claims, 3 Drawing Sheets

METHOD AND DEVICE FOR ROCK DRILLING

FIELD OF THE INVENTION

The invention concerns a method for producing shockwave pulses. The invention also concerns a device for producing shockwave pulses. Further the invention concerns a rock drilling machine including such a device and a drill rig.

BACKGROUND OF THE INVENTION

During rock drilling, shockwave pulses are generated in the form of pressure force pulses, which are transmitted from a shockwave creating device, such as a percussion device, through a drill string all the way to a drill bit. The buttons of the drill bit are thereby pressed with high intensity against the rock and accomplishes crushing and forming of crevices in the meeting rock.

In conventional rock drill machines shockwave pulses are generated by a percussive piston, which strikes against a drill shank for further transfer of the shockwave to the drill string. In convention rock drilling with rock drill machines including percussive pistons there are limited possibilities of controlling the shape of the shockwave.

The present invention relates to another type of shockwave producing machines, here called pulse machines (in rock drilling pulse drilling machines). These machines work differently from the machines mentioned above that are equipped with a percussive piston, to the extent that a pressure fluid is brought to create a force that periodically acts against a piston adapter in the form of an impulse piston, which in turn, in the case of a rock drilling machine, presses against and transmits shockwave pulses to a drill string. The impulse piston, which is not to be mistaken for the percussive piston in a conventional machine, has a relatively small mass, which does not have any influence of importance on the function of the pulse machine. As an example of the background of the invention, WO 2004/073933 could be mentioned.

THE AIM AND MOST IMPORTANT FEATURES OF THE INVENTION

It is an aim of the present invention to provide a method and a device as indicated above, that provide developments and enhancements in respect of previously known pulse machines, and particularly give the possibility of enhanced shockwave shape control. In particular it is an aim to be able to produce more effective shockwave pulses for the particular application.

These aims are obtained in respect of a method and device as mentioned initially through the characterizing portions of the respective independent patent claims.

The invention provides good possibilities of controlling the length of the shockwave pulse whereby are achieved a number of important advantages. There is thus, in the case of rock drilling, possible to drill with a rock drilling efficiency which is regulated in the direction of an enhancement. For other types of pulse machines it is also essentially a question of providing a more efficient working process.

In operation, a first force is acting on the impulse piston in the direction opposite to a tool direction. In operation a second force acts in operation in the tool direction R.

According to the invention, the second force is during an entire pulse cycle kept greater than the first force, at the same time as the feed force together with the first force periodically is made to exceed the second force. Hereby the feed force is thus used together with the first force to provide displacement of the impulse piston in the direction opposite to the tool direction. The following relief of the first fluid pressure thereafter results in inducing a shockwave pulse into a drill string or the like.

This way of adjust the forces to each other i.a. has the advantages that no pulses are induced until the machine is pressed-on with the feed force, since the impulse piston without (or with a low) feed force in a so called initial portion is pressed against a stop that is arranged inside the machine housing. Idle strikes are thereby effectively avoided which could otherwise be harmful for the machine and, for example, affect a drill string negatively and in particular induce loosening of threads in the drill string.

In the case of rock drilling, in principle it is the case that with high resistance against rock penetration, the rock drilling efficiency becomes higher with relatively shorter shockwave pulses, whereas with low resistance against rock penetration, the rock drilling efficiency will be lower with relatively longer shockwave pulses.

The factors that affect the resistance against rock penetration are parameters such as rock hardness and size of the drill bit and in particular the area of the hard metal buttons at the front of the drill bit that strikes against the rock. The resistance against rock penetration thus increases with increased rock hardness as well as with increased drill bit size.

For that reason is provided through preferred aspects of the invention the possibility of enhancing the rock drilling efficiency by the possibility of adjusting the length of the shockwave pulse to prevailing rock penetration resistance (rock hardness, drill bit size etc.) in the direction of enhanced rock drilling and efficiency for the particular drilling situation. It should be noted that, basically, the rock drilling efficiency is affected by the pulse energy, which depends on the pulse shape. This in turn is dependent of the hydraulic press level.

According to one aspect of the invention, the method can be controlled such that prior to a rock drilling process, with known rock hardness and a chosen drill bit with a certain degree of wear, a certain shockwave length is chosen. Possibly this could be varied according to previous knowledge, for example, about the variation of rock hardness along the length of the drill hole.

In a preferred aspect of the invention, the shockwave length could be controlled by the piston being pressed-in a chosen length, with the aid of the feed force. Thereafter the force is released onto the impulse piston (by releasing the impulse piston), the latter is displaced forwardly, normally until it reaches a mechanical stop, which results in limitation of the shockwave length. In the case were the impulse piston during an impulse does not reach the stop, the shockwave length will depend on the magnitude of the force acting on it, and in particular is "behind" the piston. In this case a so called floating position can prevail.

Through preferred embodiments of the invention it is, however, also possible, during a single rock drilling process, i.e. during the process of drilling a drill hole, to control the length of the shockwave and thereby the drilling depending on variation of resistance against rock penetration along the length of the drill hole.

The control of the length of said displacement can be achieved in different ways, which could be advantageously adapted to different applications and to different existing systems, wherein the invention is used.

Through the possibilities of controlling the shape of the shockwave by controlling the process of relieving the first fluid pressure, the front edge of the shockwave piston, or the up-flank, could be regulated further by adapting to material, usually rock, to be worked on in respect of the hardness of the material, the shape of the tool, etc.

Particularly advantageous is to control the length of the shockwave pulse as a response to a sensed drilling parameter such as for example shockwave reflex or drilling rate. This way the invention can be used in order to adapt the rock drilling parameters in real time to for example varying hardness of the rock to be worked in a manageable way. It is also possible to control the machine according to efficiency, which is defined as the amount of worked rock divided by the amount of energy applied to the machine.

The invention also allows the possibility of achieving simplified damping such that shockwave reflexes are received by elements providing said second force.

In particular is preferred that said second force is obtained from pressurized fluid in a second chamber for action on the impulse piston. The pressure from this fluid can be regulated for controlling the form and amplitude of the shockwave. Certain influence on the shockwave length can also be obtained through such regulation.

The invention allows the parameters to be set such that the impulse piston during drilling is controlled in the direction of a "floating position", wherein it will not come into contact with metal surfaces in either tool direction or in the opposite direction, but instead is "supported" by fluid on its both sides, which leads to reduced noise and reduced wear.

According to a particular aspect it has been understood that the arrangements and principles disclosed in the present description and claims for controlling a pulse machine in order to control the length and the shape of the shockwave are adaptable also in pulse machines working differently. This includes such pulse machines where the pulse is produced by rapid pressurizing of a chamber being on the side of the impulse piston which is turned from the tool direction. It also includes such machines where the pulse is produced by rapid release of the force of the side of the impulse piston which is directed in the tool direction but where the different forces acting on the impulse piston are not necessarily balanced such that in an initial position the impulse piston is pressed against a stop arranged in the housing. This aspect is subject to claims 46 and 47. Features denoted in the claims 1-45, which concern control arrangements and principles, and in particular how it is used in order to control a process such as a rock drilling process in the direction of for example enhanced efficiency, and which are described in the associate description text can therefore also be sub-ordered the claims 46 and 47.

Advantages of a device according to the invention corresponding to the above advantages in respect of the different method aspects are obtained with corresponding device claims. Further features and advantages of different aspects of the inventions appear from the following detailed description.

BRIEF DESCRIPTION OF DRAWINGS

The invention will now be described in greater detail by way of embodiments and with referenced to the annexed drawings, wherein.

DETAILED DESCRIPTION OF EMBODIMENTS

Figure 1:
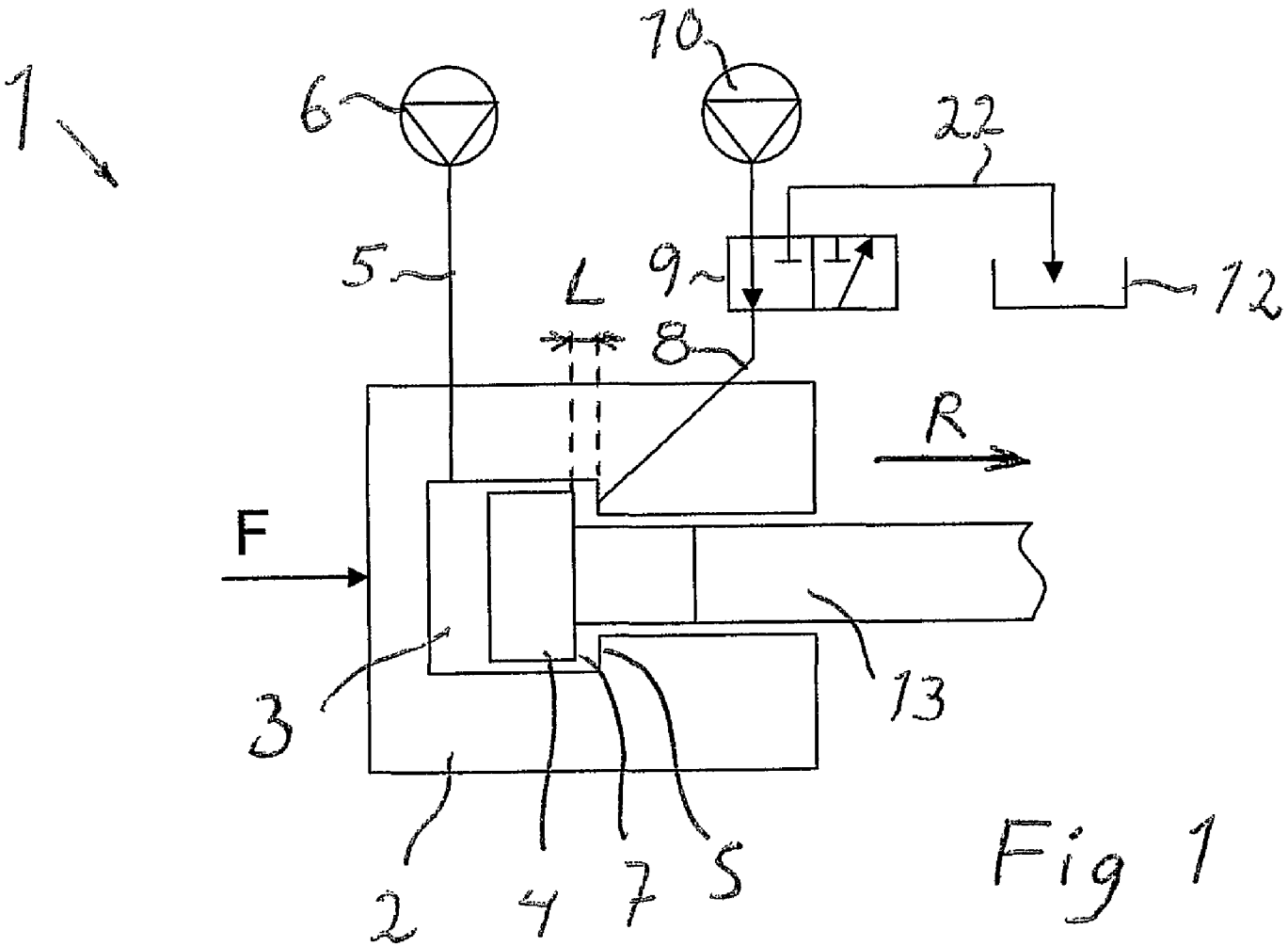
FIG. 1 diagrammatically shows a first embodiment of a pulse machine according to the invention, partly in section, FIG. 2 diagrammatically shows a second embodiment of a pulse machine according to the invention, partly in section.

A pulse drilling machine according to the invention which is generally indicated with 1, includes a housing 2, wherein an impulse piston 4 is reciprocally moveable in a limited manner. The impulse piston lies over an interface against an upper portion of a drill string indicated with 13. Adjoining to the lower side of the impulse piston 4 is arranged a first chamber 7, which can be pressured with a first pressure $P_1$ affecting the impulse piston with a first force in a direction opposite to a tool direction R. The pressure in the first chamber 7 is controlled in that a valve 9 periodically transmits exit pressure from a pump 10 to this chamber 7 over a pressure conduit 8. From the valve also leads a tank conduit 22 to the tank 12 for periodic relief of the first chamber 7.

Adjoining to the second side of the impulse piston 4 is arranged a second chamber 3 which can be pressurized with a second pressure $P_2$ for producing a second force acting in the tool direction R.

In a preferred embodiment, the pressure in the second chamber 3 is nearly constant, withheld by a pressure pump 6 over a pressure conduit 5 and levelled by an (not shown) accumulator.

On the housing 1 of the pulse machine is also acting, as conventionally, a feed force F in said tool direction R.

The first force produced by the first pressure in the first chamber 7 and acting of an impulse piston 4 in the direction opposite to the tool direction R, is under an entire pulse cycle lower than said second force. That is, which shall be noted, also in the position shown in FIG. 1 for the valve 9, wherein in principle the pump pressure from the pump 10 prevails in the first chamber.

However, the sum of the first force and the feed force F is under a part of a pulse cycle set to be greater than said second force such that during this part of the pulse cycle, the impulse piston is pressed essentially to the position shown in FIG. 1, where the lower edge of the impulse piston 4 has been displaced a distance L from its most advanced extreme position in the tool direction R, wherein it lies against a stop S arranged in the machine housing. This position against the stop is taken by the impulse piston initially during actuated pressures through the pumps 6 and 10 and no (or low) feed force. The stop is suitably an end wall in the first chamber 7 which is position most forwardly as seen in the tool direction R.

When the impulse piston 4 has been displaced this distance L, which corresponds to what is being predetermined for a pulse cycle, for example sensed through a distance sensor 15 in the housing, the first force in the first chamber 7 is rapidly released by switching the valve 9, wherein, through the pressure in the second chamber 3, the impulse piston 4 receives a forward movement in said direction R which in turn results in that a shockwave is induced in the drill string 13 for transmission to a not shown drill bit. It should be noted that the control can be achieved without the distance L being measured or estimated. Thereby it could be sufficient to regulate F to the background of parameters relating to the drilling process. Examples of this can be drilling rate and efficiency. The efficiency is dependent of the energy reflected from the rock, which can be sensed as pressure variations in the chamber 3 depending on reflected shockwave, be sensed for example with an electronic circuit measuring a durability of the separation of the impulse piston from the drill string at shockwave reflection, or by means of strain gauges on the drill string in order to sense elastic deformations in the drill string during shockwave reflection.

After the shock this way has been completed, again the first chamber is pressurized by resetting the valve 9 for restoring conduit contact with the pump 10, whereupon the impulse piston 4 is again displaced a chosen distance, which could be L or a distance different from L, which as an example can be determined through sensed drilling parameters and be determine by a CPU belonging to the system. It is, however, possible to use the machine without the support provided by a CPU.

Figure 3:
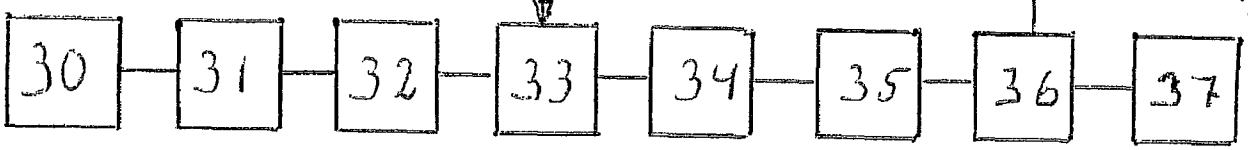
FIG. 3 shows a block diagram of a method according to an embodiment of the invention.

An example of a method sequence according to the invention is diagrammatically illustrated in FIG. 3, wherein:

Position 30 indicates the start of the sequence,

Position 31 indicates pressurizing of the second chamber 3.

Position 32 indicates switching of a valve 9 into the position shown in FIG. 1 for pressurizing the first chamber 7.

Position 33 indicates initial applying of a feed force F to the machine 1, thereafter regulating the feed force.

Position 34 indicates sensing through a distance sensor the length L of pressing-in of the impulse piston and transmitting a related signal to a CPU.

Position 35 indicates that CPU controls if said signal corresponds to (or exceeds) a stored or determined value and sends in case of correspondence a control signal to the valve 9, in case the machine has an electronically controlled valve, for switching and thereby relieving the first chamber for initiating of the production of a shockwave.

Position 36 indicates sensing of reflected shockwave or drilling rate and adaption (through CPU) of that value for said signal and thereby L to apply for the next shockwave cycle.

The sequence thereafter returns to position 33 or to position 37, which indicates the end of the sequence.

Figure 2:
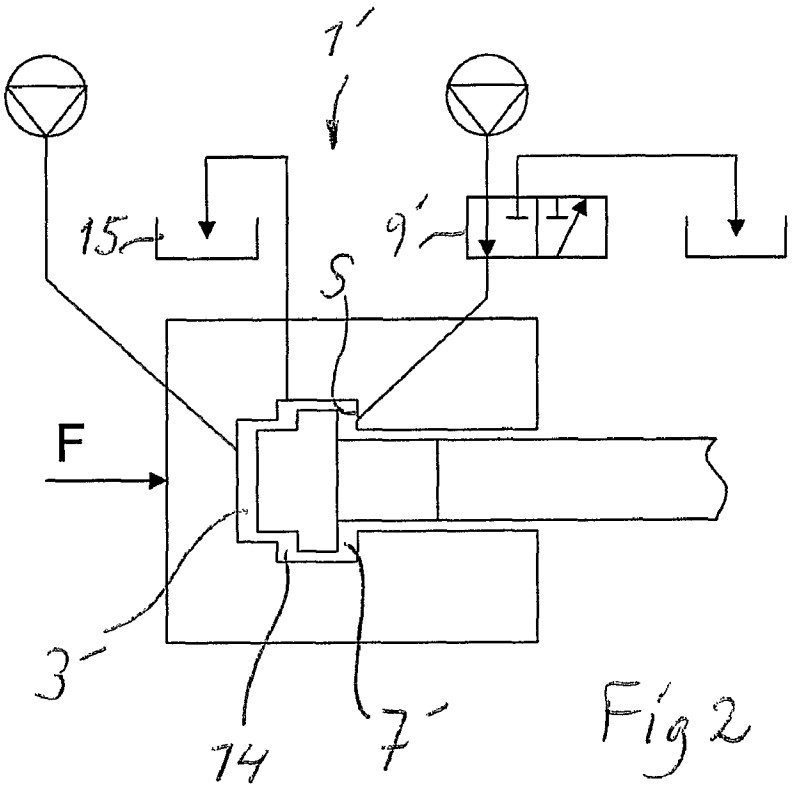

In FIG. 2 is shown a pulse drilling machine 1' with a housing 2', which differs from the one shown in FIG. 1 only by the second chamber 3' being constructed with a relatively smaller diameter in respect of the first chamber 7'. With 14 is indicated an annular chamber which is permanently open to tank and formed in the same cylinder space as the first chamber 7'. In this variant, the effective surfaces of the first chamber are more balanced to each others. Besides, the chamber 14 can comprise a leakage chamber, so that there is provided the possibility of managing leakage through the slots being present between the impulse piston and the receiving cylinder. A further advantage is the possibility to provide replacement of hydraulic oil in the chambers 3' and 7' in order thereby to achieve cooling of the machine.

Figure 4:
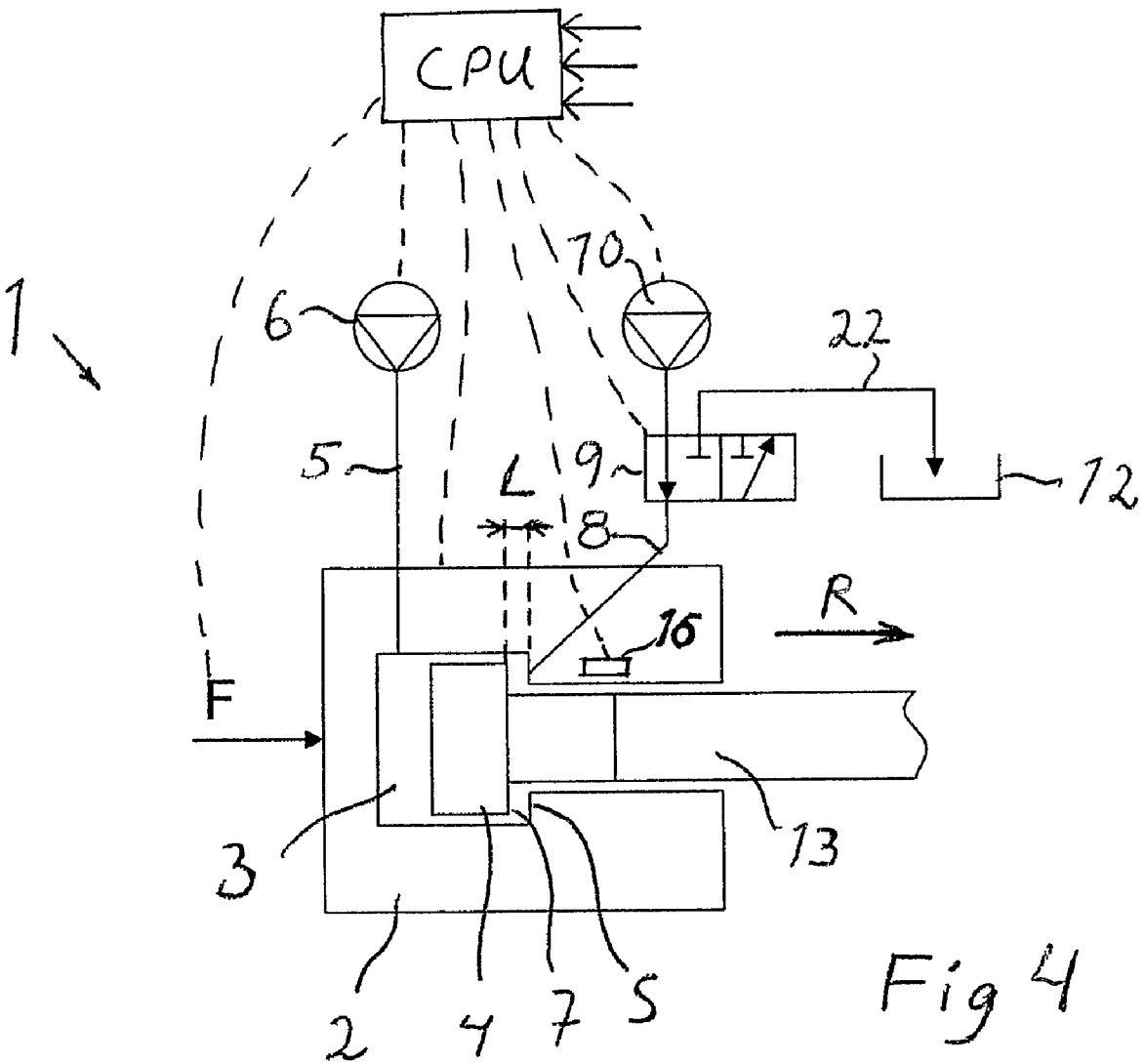
FIG. 4 shows a further embodiment of the pulse machine according to the invention, partly in section.

In FIG. 4 the pulse machine in FIG. 1 is shown completed with the means for regulating and controlling the drilling process. These means are examples of such means that are used in the method sequence according to FIG. 3 and the corresponding text above. A CPU is thus shown, onto which is connected sensor cables and control signal cables, indicated with interrupted lines. In this embodiment there is arranged a distance sensor 16 in the housing in order to sense the displacement of the impulse piston. A corresponding signal is transmitted by the distance sensor 16 to the CPU, which has the ability to regulate the machine in order, in a new pulse cycle, to induce a shockwave, which can have a different length or shape than the previous shockwave. As an example, the feed force can be controlled for changing the distance L. The CPU can also be arranged to control the frequency of the valve and opening and closing characteristics in order to affect the shockwave. Concerning the regulation, it could be supplied to the intake interface of the CPU (marked with three arrows) supply signals concerning a plurality of other parameters such as size and/or character of reflected shockwave, energy supplied to the machine, amount of processed rock etc. The CPU can subsequently control the pulse production process in the machine in the direction of e.g. example enhanced efficiency.

The invention can be modified within the scope of the claims. The pulse length can, as indicated above, be controlled by regulating of one of a plurality of control parameters that effect pulse production, i.a. of the feed force, wherein a low feed force results in a short movement opposite to the tool direction and short pulse length and a high feed force gives a long movement opposite to the tool direction and a long pulse length. Also variation of the pressure in the second chamber or alternatively the durability of a pulse cycle and, respectively, the portion of the pulse cycle where the pressing-in occurs, can contribute in this connection. Means for controlling the feed force can be the usual pressurizing means acting on a percussive tool modified in order to allow control of the magnitude of the supplied force.

Rock characteristics that can be read from sensed shockwave reflexes can be used or be considered respectively in order to control the length of the shockwave pulse. For the purpose of loosening the threads in a drill string, the pressure acting on the impulse piston and thereby the first and the second force can be controlled for shortly achieving idle strikes, that is without any feed forces worth mentioning.

Another control principle is about controlling the shockwave with characteristics, as in particular shockwave length starting out from a chosen lowest efficiency or, alternatively, a chosen lowest drill rate in order to e.g. minimize energy supplied to the machine. Regulation can also be had in the direction of enhanced machine working life, wherein for example higher frequency and lower pulse energy can come into question. In case of control for increased production economy all relevant systems included are taken into account.

Control of the machine can be had for operation in withheld floating position of the impulse piston. Hereby the position of the impulse piston in the machine housing can be sensed directly through per see known means or still more preferred indirectly from the outside for example through e.g. capacitive or inductive sensing of a marker associated with the drill string.

The second force can be achieved through elastic means such as springs of metal, rubber etc., a metal rod etc. The amplitude of the shockwave pulses, frequency as well as their shape can be controlled according to the invention. Concerning the shape, for example the process of opening the valve 9 to tank can be controlled in order to regulate how the up-flank of the shockwave pulse is shaped. Rapid opening gives, in principle, steep up-flank and a more extended period gives more sloping up-flank. A flatter up-flank can contribute to reduction of rock reflexes but cause effect losses in the valve. Also the shape of the down-flank of the shockwave can be controlled by for example the movement pattern of the valve.

The valve is preferably one known per se with rotational valve body, which is provided with openings for achieving its functions.

Controlling the pulse frequency can be achieved by controlling the rotational speed of the valve body. Many other kinds of valves can come into question for example solenoid valves or so called spreader valves.

The valve can be included in a control device including regulating devices for regulating the progress of the pressure reduction in the first chamber. This has the advantage that the rising time and/or the durability of the shockwave can be regulated based on the properties of the drilled material such that a greater part of the shockwave energy can be received by the drilled-on material with reduced reflections as a result.

The control device can include regulating devices for regulating the progress of the pressure reduction in said counter-action chamber. This has the advantages that the rising time and/or the durability (length) of the shockwave can be regulated based on the properties of the drilled-on material such that a greater part of the shockwave energy can be received by the drilled-on material with reduced reflections as a result.

The device for pressure reduction can include a control valve for connection to the first chamber, wherein the control valve can include at least one opening for controlling said pressure reduction by discharging pressure medium inside the chamber during operation. The pressure reduction can be controlled by controlling the opening process of the control valve. For example the control valve can be constructed with pressure relief grooves for regulating the pressure reduction. This has the advantages that the progress of the pressure reduction can be regulated in a simple manner.

The first chamber can include a plurality of outlets, wherein said outlets can be opened controllably. The outlets can have different diameters. This so that pressure reduction can be regulated in a simple manner by opening and closing of applicable outlets.

The outlets can be connected with one or several reservoirs by means one or several fluid paths, wherein said reservoirs in operation can be pressurized to different pressures, wherein a stepwise and/or continuous pressure relief of the first chamber can be obtained by opening of said outlets. This has the advantage that the pressure reduction can be achieved without the energy loss which is associated with throttle regulation. The valve can include at least one opening for controlling said pressure reduction by discharge of pressure medium inside the counter action chamber during operation. The pressure reduction can be controlled by controlling the progress of opening of the control valve. For example, the control valve can be constructed with pressure relief grooves for regulating pressure reduction. This has the advantages that the progress of the pressure reduction can be controlled in a simple manner.

The different pressures that are transmitted to the two chambers of the pulse machine can be varied, either by controlling the respective pump or through intermediate, not shown, pressure regulating valves. In a simple variant, a system pressure of a rig prevails in both chambers. As a principle, it applies that higher pressure gives greater pulse amplitude of the pulse and, given the same pulse length, higher pulse energy.

Damping can be simplified through a machine according to the invention by reflected shockwaves being received by the second chamber, which will have the capacity of working as a "damping cushion". The machine can also be controlled such that it goes into a floating position, where the impulse piston does not come into contact with the ends of the chambers with adequate adjustment of F, $P_1$ and $P_2$.

A machine, adapting the invention has the potential to have a high efficiency. Thus, energy is consumed only corresponding to the amount of pressure fluid that corresponds to the pressing-in, the displacement of the impulse piston.

The invention claimed is:

1. Method for producing shockwave pulses in a tool direction of a pulse machine having a housing, wherein an impulse piston is arranged, wherein the impulse piston is influenced by a first force in a direction opposite to said tool direction through a first fluid pressure in a first chamber, and by a second force in said tool direction, wherein a shockwave pulse is produced through a rapid relief of the first fluid pressure after displacement of the impulse piston relative to the housing in a direction opposite to the tool direction, said shockwave pulse having a length and an amplitude, the steps of the method comprising:

setting the first force during a complete pulse cycle to be lower than the second force, and bringing the sum of a feed force acting on the pulse machine and the first force to exceed the second force during part of the pulse cycle in order to achieve said displacement.

2. Method according to claim 1, wherein the length of the shockwave pulse is controlled through controlling the length of said displacement.

3. Method according to claim 2, wherein that the magnitude of the feed force is controlled for controlling the length of said displacement.

4. Method according to claim 1, wherein the magnitude of the feed force is controlled for controlling the length of said displacement.

5. Method according to claim 1, wherein the magnitude of the first fluid pressure is controlled for controlling the length of said displacement.

6. Method according to claim 1, wherein the durability of the displacement is controlled for controlling its length.

7. Method according to claim 1, wherein the shape of the shockwave pulse is regulated by the progress of the relief of the first fluid pressure being regulated.

8. Method according to claim 7, wherein the progress of the relief of the first fluid pressure is controlled by the flow through a valve being regulated.

9. Method according to claim 1, wherein the magnitude of shockwave reflexes is sensed and the length of the shockwave pulse is controlled as a response thereto.

10. Method according to claim 9, wherein in case of higher resistance against rock penetration, the lengths of the shockwave pulses are controlled in the direction of relatively shorter shockwave pulses, whereas in case of lower resistance against rock penetration, the lengths of the shockwave pulses are controlled in a direction of relatively longer shockwave pulses.

11. Method according to claim 1, wherein shockwave reflexes are sensed for determining the magnitude of rock characteristics and the length of the shockwave pulse is controlled as a response thereto.

12. Method according to claim 1, wherein the shockwave pulse length is controlled as a response to the magnitude of drilling rate.

13. Method according to claim 1, wherein the length of the shockwave pulse is controlled as a response to the magnitude of the efficiency.

14. Method according to claim 1, wherein the length of the shockwave pulse is controlled as a response to the magnitude of energy supplied to the machine.

15. Method according to claim 1, wherein the length of the shockwave pulse is controlled as a response to the amount processed rock per time unit.

16. Method according to claim 1, wherein the frequency for producing shockwave pulses is regulated.

17. Method according to claim 1, wherein a damping force for the pulse machine is regulated.

18. Method according to claim 1, wherein the second force is obtained through a second fluid pressure in a second chamber.

19. Method according to claim 18, wherein the second fluid pressure is regulated.

20. Method according to claim 19, wherein the amplitude of the shockwave pulse is controlled by the second fluid pressure being regulated.

21. Method according to claim 18, wherein the amplitude of the shockwave pulse is controlled by the second fluid pressure being regulated.

22. Method according to claim 1, wherein leak flow from at least one of first and at occurrence of a second chamber to a leakage chamber is provided.

23. Method according to claim 1, wherein the machine is regulated in order to obtain a floating position for the impulse piston in operation.

24. Method according to claim 23, wherein the position of the impulse piston in the machine housing is detected directly or indirectly.

25. Device in a pulse machine for producing shockwave pulses in a tool direction including a housing wherein an impulse piston is arranged to be influenced by a first force in a direction opposite to said tool direction by a first fluid pressure in a first chamber and by a second force in said tool direction, and including means for achieving a rapid relief of the first fluid pressure, whereby a shockwave pulse is produced, after displacement of the impulse piston relative to the housing in a direction opposite to the tool direction, said shockwave pulse having a length and an amplitude, wherein the device includes:

means for setting the first force during a complete pulse cycle to be lower than the second force, and means for bringing the sum of a feed force acting on the pulse machine and the first force to exceed the second force during part of the pulse cycle in order to obtain said displacement.

26. Device according to claim 25, wherein said device includes means for regulating the length of said displacement and thereby controlling the length of the shockwave pulse.

27. Device according to claim 26, wherein said device includes means for regulating the magnitude of the feed force for controlling the length of said displacement.

28. Device according to claim 25, wherein said device includes means for regulating the magnitude of the feed force for controlling the length of said displacement.

29. Device according to claim 25, wherein said device includes means for regulating the magnitude of the first fluid pressure for controlling the length of said displacement.

30. Device according to claim 25, wherein said device includes means for regulating the durability of the displacement for controlling its length.

31. Device according to claim 25, wherein said device includes means for regulating the shape of the shockwave pulse by controlling the progress of relief of the first fluid pressure.

32. Device according to claim 31, wherein said device includes a control valve for controlling the progress of relief of the first fluid pressure.

33. Device according to claim 25, wherein said device includes means for controlling the length of the shockwave pulse as a response to the magnitude of sensed shockwave reflexes.

34. Device according to claim 25, wherein said device includes means for controlling the length of the shockwave pulse as a response to rock characteristics that are determined from said shockwave reflexes.

35. Device according to claim 25, wherein said device includes means for controlling the length of the shockwave pulse as a response to drilling rate.

36. Device according to claim 25, wherein said device includes means for controlling the length of the shockwave pulse as a response to the magnitude of the efficiency.

37. Device according to claim 25, wherein said device includes means for controlling the length of the shockwave pulse as a response to the magnitude of energy supplied to the machine.

38. Device according to claim 25, wherein said device includes means for controlling the length of the shockwave pulse as a response to the amount of rock processed per time unit.

39. Device according to claim 25, wherein said device includes means for controlling the length of the shockwave pulses in the direction or relatively shorter shockwave pulses in case of higher resistance against rock penetration and to control the lengths of the shockwave pulses in the direction of relatively longer shockwave pulses in case of lower resistance to rock penetration.

40. Device according to claim 25, wherein said device includes means for regulating the frequency for the production of shockwave pulses.

41. Device according to claim 25, wherein said device includes means for regulating a damping force of the pulse machine.

42. Device according to claim 25, wherein said device includes means for achieving the second force by supplying a second fluid pressure in a second chamber.

43. Device according to claim 42, wherein said device includes means for regulating the second fluid pressure.

44. Device according to any claim 25, wherein said device includes a leakage chamber for providing a leak flow from at least one of the first and at occurrence the second chamber.

45. Device according to claim 25, wherein said device includes means for regulating the machine for operation in maintained floating position of the impulse piston.

46. Device according to claim 25, wherein said device includes means for directly or indirectly detecting the position of the impulse piston in the machine housing.

47. Rock drilling machine including a device according to claim 25.

48. Rock drilling rig including a rock drilling machine according to claim 47.

* * * * *

UNITED STATES PATENT AND TRADEMARK OFFICE

CERTIFICATE OF CORRECTION

PATENT NO. : 8,151,899 B2
APPLICATION NO. : 12/311018
DATED : April 10, 2012
INVENTOR(S) : Goran Tuomas It is certified that error appears in the above-identified patent and that said Letters Patent is hereby corrected as shown below:

Claim 39 (Column 10, Line 24): Delete “or” and substitute --of--.

Signed and Sealed this
Third Day of July, 2012

David J. Kappos

David J. Kappos
*Director of the United States Patent and Trademark Office*